United States Patent [19]

Bloemers

[11] 4,016,850

[45] Apr. 12, 1977

[54] PORTED CYLINDER CONSTRUCTION FOR A TWO-CYCLE ENGINE

[75] Inventor: James L. Bloemers, Fond du Lac, Wis.

[73] Assignee: Brunswick Corporation, Skokie, Ill.

[22] Filed: Mar. 7, 1975

[21] Appl. No.: 556,557

Related U.S. Application Data

[62] Division of Ser. No. 444,767, Feb. 22, 1974.

[52] U.S. Cl. ..... 123/193 C; 92/171

[51] Int. Cl.[2] ..... F02F 1/10

[58] Field of Search ..... 123/193 C, 193 R, 191 A, 123/32 AA, 41.84; 92/169, 171

[56] References Cited

UNITED STATES PATENTS

| | | | |
|---|---|---|---|
| 1,905,062 | 4/1933 | Schaeffer | 123/193 R |
| 2,395,110 | 2/1946 | Forrest | 123/193 C X |
| 2,440,645 | 4/1948 | Pyk et al. | 123/193 C X |
| 2,845,918 | 8/1958 | Goodzeit | 123/193 R |
| 2,852,010 | 9/1958 | Sehreiber | 123/193 C X |
| 3,382,857 | 5/1968 | Foster et al. | 123/193 R |
| 3,643,637 | 2/1972 | Strössner et al. | 123/193 C X |
| 3,657,078 | 4/1972 | Schweikher | 123/193 C X |
| 3,800,751 | 4/1974 | Glassey et al. | 123/193 C X |
| 3,896,009 | 7/1975 | Kobayashi et al. | 123/193 C X |
| 3,903,951 | 9/1975 | Kaneko et al. | 123/193 C X |

*Primary Examiner*—C. J. Husar
*Assistant Examiner*—Ira S. Lazarus
*Attorney, Agent, or Firm*—Hopgood, Calimafde, Kalil, Blaustein & Lieberman

[57] ABSTRACT

The invention contemplates an improved ported cylinder construction and method wherein the precision of die-casting is used in the separate construction of a cylinder body and of a cylinder liner wherein ports and grooves are so formed in these parts as to cooperatively define inlet and exhaust passages, upon correctly registered assembly of the ports. In the specific form disclosed, the assembled cylinder provides for side-ported exhaust and an array of inlet-mixture passages for communicating a crankcase-compressed combustible charge to liner-bore regions selected for best scavenging of exhaust products.

10 Claims, 10 Drawing Figures

PORTED CYLINDER CONSTRUCTION FOR A TWO-CYCLE ENGINE

This application is a division of my copending application Ser. No. 444,767, filed Feb. 22, 1974.

This invention relates to a two-cycle cylinder construction, particularly applicable to use of aluminum.

As is well known, two-cycle engines use the crankcase to compress the incoming fuel-air charge, which then passes upwardly through transfer passages and ports which are uncovered as the piston moves down. There is considerable art involved in shaping and positioning these passages and ports to obtain the most efficient scavenging of the cylinder by the incoming charge, and the shape of these transfer passages and ports can therefore become intricate. For this reason, it has been common practice, and indeed the only known practice, for the case of aluminum cylinders (as for outboard motors) to cast the cylinder around a sand core that has been pasted together by hand. One reason for going to so much trouble is to obtain an all-aluminum cylinder which can then be chrome-plated along its bore. The aluminum carries away the heat, and the chrome plate helps the cylinder withstand abuse of high-speed, high-temperature operation. The net result is that such cylinders are from 25 to 30 percent lighter in weight and are able to provide about 10 percent greater power, as compared to iron or steel constructions.

It is an object of the invention to provide an improved construction and method of construction for cylinders of the character indicated.

Another object is to achieve the above object without sacrifice of the weight and power advantages of aluminum.

A specific object is to achieve the above objects in a configuration lending itself to die-casting techniques and to the elimination of sand-core and machining operations which have previously been necessary.

Another specific object is to provide a novel die-castable cylinder configuration which inherently lends itself to a variety of modifications in regard to transfer-passage and port contouring, complexity and sophistication, to the end that an inlet charge can more effectively scavenge the cylinder of exhaust products of the previous cycle of operation.

A general object is to achieve the above with substantial economies of manufacturing costs, with superior production reproducibility of completed cylinders, and with inherent simplification and cost-reduction as to maintenance and replacement of parts.

Other objects and various further features of novelty and invention will be pointed out or will occur to those skilled in the art from a reading of the following specification in conjunction with the accompanying drawings. In said drawings, which show, for illustrative purposes only, a preferred embodiment of the invention:

Figure 1:
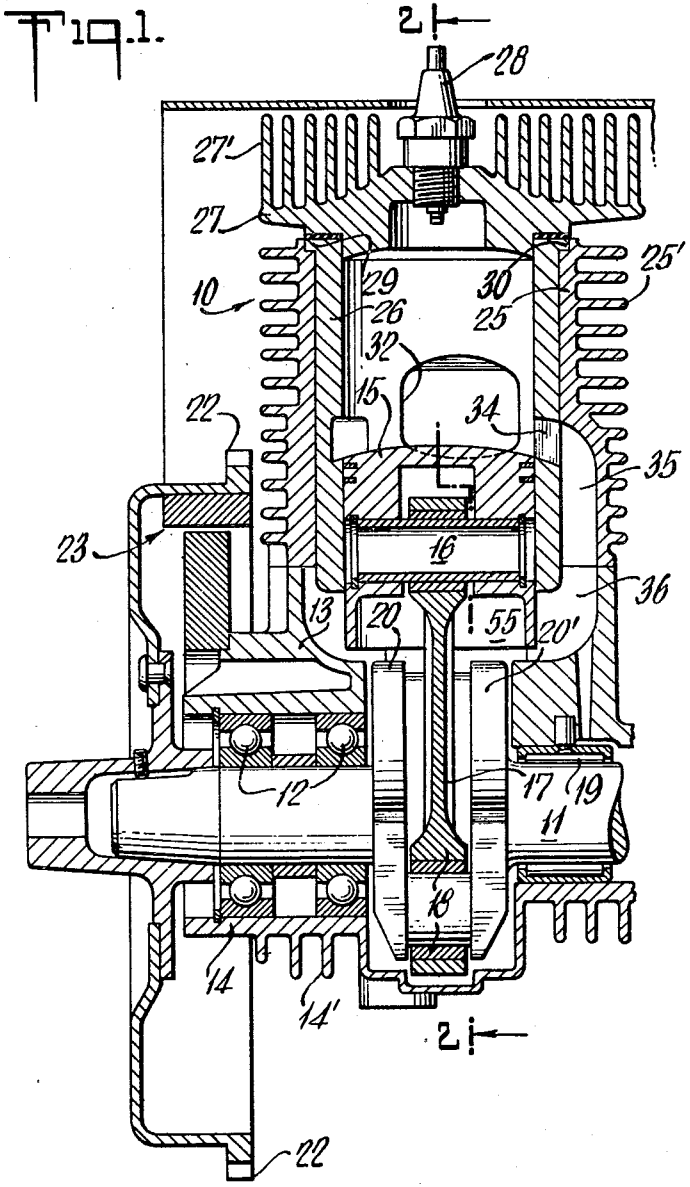
FIG. 1 is a fragmentary vertical sectional view in the plane of the crankshaft axis and of a cylinder axis in a two-cycle engine to which the invention has been applied.
Figure 2:
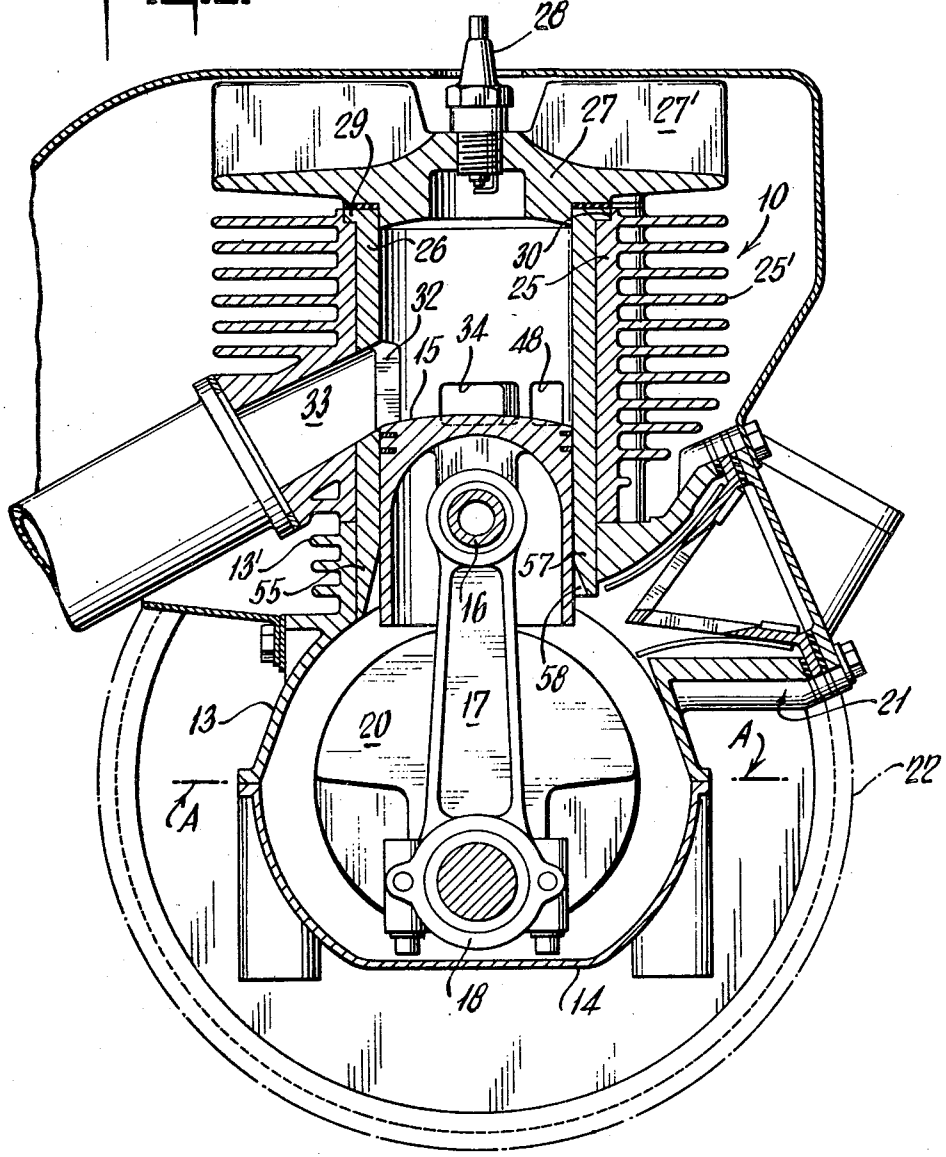
FIG. 2 is a sectional view taken along the line 2—2 of FIG. 1.

Referring to FIGS. 1 and 2, the invention is shown in application to one cylinder 10 of a two-cycle internal-combustion engine which may comprise a plurality of such cylinders (not shown) to drive a single crankshaft 11. Ball bearings 12 support an end of crankshaft 11 in a two-piece crankcase comprising (a) a block 13 to which cylinder 10 is assembled and (b) a shell or pan 14; the latter has sealed removable connection to block 13 along a parting plane A—A (see FIG. 2) through the axis of crankshaft rotation. A piston 15 is movably guided within cylinder 10, being wrist-pin connected at 16 to a connecting rod 17 having connection at 18 to a crank offset of shaft 11. As shown, needle-bearing means 19 supports the crankshaft between pistons, and balancing counterweights 20—20′ are symmetrically disposed in opposed adjacency to the connecting rod 17 and its crank connection to shaft 11. The block 13 includes provision at 21 for inlet-manifold connection to the crankcase, and a starter-ring gear 22 and magneto 23 elements are shown for the outer end of that part of the engine which is depicted in FIGS. 1 and 2.

Each cylinder 10 is of three-part construction, comprising a cylinder-body part 25 (see also FIGS. 3 and 4), a sleeve-liner part 26 (see also FIGS. 5, 6 and 7), and a head part 27 with provision for accommodating a spark plug 28. The upper end of sleeve 26 is flanged at 29, to locate in a counterbore 30 in the body part 25, and head 27 has a gasketed fit to flange 29, being clamped to block 13 by through-bolts or studs on plural alignments, indicated by bores 31 in FIG. 4. Cooling-fin formations are provided as appropriate on parts already identified and for convenience are identified by primed notation of such parts, namely, at 25′-27′-13′-14′.

In the presently disclosed two-cycle engine, each cylinder has side-ported exhaust, on the side of the engine which is opposed to that of inlet manifolding 21. Thus, an exhaust side-port formation 32 in sleeve 26 registers with an exhaust side-port formation 33 in body 25. The exhaust passage defined by these aligned ports is downwardly inclined and is fully open for the "bottom-center" position of crank throw shown in FIG. 2.

Each cylinder also has side-ported inlet provision for combustible mixture compressed in the crankcase. Thus, an inlet side-port formation 34 in sleeve 26 registers with a transfer-passage formation 35 in cylinder body 25, and formation 35 registers with a transfer-passage formation 36 in engine block 13. Both formations 35–36 are in fact grooves or channels which rely upon the presence and coaction of sleeve 26 in order to complete their definition and function as a single transfer passage for communicating combustible mixture from the crankcase to the upper end of the cylinder, via side port 34.

It has been indicated generally above that the use of a sleeved cylinder (25–26) is of particular importance to the present invention, in that for the case of a light-weight, high-conductivity metal such as aluminum, it is possible with relative ease to create port and transfer-passage formations of intricacy and sophistication hitherto unavailable. This and other features of the invention will appear from a more detailed consideration of FIGS. 3 to 8.

Figure 3:
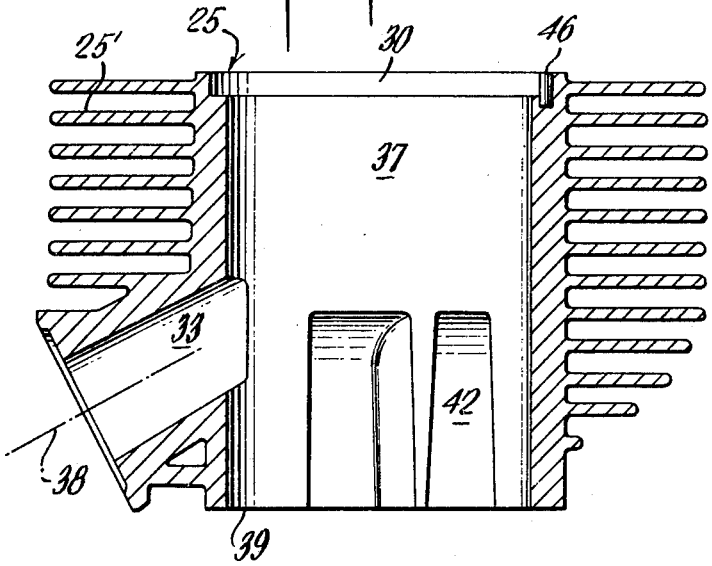
FIG. 3 is a vertical sectional view through a cylinder-body part of FIG. 1, the sectional plane being taken so as to include the axis of the exhaust port.
Figure 4A:
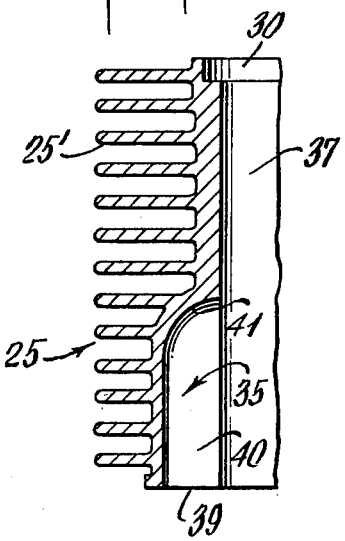
FIGS. 4A and 4B are fragmentary sectional views, taken in FIG. 4 at 4A—4A and at 4B—4B, respectively.
Figure 4:
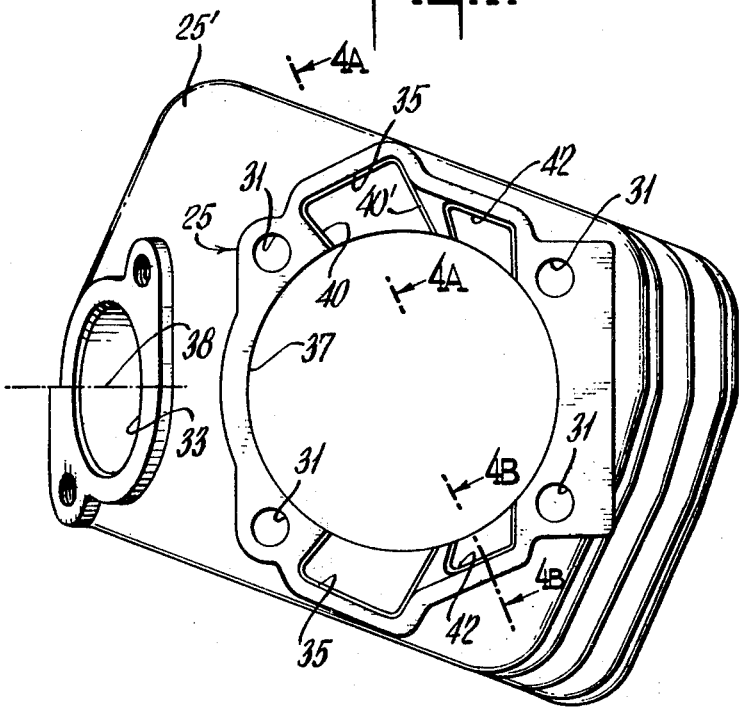
FIG. 4 is a bottom-end view of the part of FIG. 3.

The detail of body part 25 in FIGS. 3 and 4 reveals that the transfer-passage groove or channel 35 is one of four, of width, depth and orientation which bear a symmetrical relationship to the plane defined by the axis of the cylindrical bore 37 and the axis 38 of the exhaust port 33; such a relationship is designedly such as to promote prompt and efficient scavenging of exhaust products of the cycle which immediately precedes the next cycle. The channel 35 is open at the lower or crankcase end 39 and with a sectional profile which preferably matches the adjacent contour of the corresponding engine-block channel 36. The vertical side walls 40—40′ of channel 35 converge in the direction of discharge into the combustion chamber, and the predominant axis of such discharge (substantially the alignment between arrows 4A—4A in FIG. 4) is preferably offset from strictly radial, i.e., in the direction offset from the cylinder axis and away from the exhaust port 33. The upper end 41 (FIG. 4A) of channel 35 is smoothly arcuate for maximum effectiveness of fresh-mixture discharge into the combustion chamber. On the opposite side of the plane of symmetry defined by the combustion-chamber axis and by the exhaust-port axis, there is a second transfer-passage groove or channel which is the mirror image of channel 35 and which therefore is assigned the same reference numeral 35.

Figure 4B:
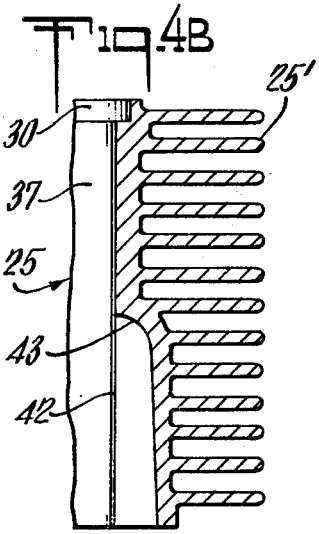

Another pair of transfer-passage grooves or channels 42 is also formed as recesses in the bore 37 of body part 25. Channels 42 meet the general description of channel 35 except that they are of smaller section, and are more remote from the exhaust port 33. As with channels 35, each channel 42 is formed with a rounded upper end 43 (see FIG. 4B) and with convergent side walls oriented to discharge fresh mixture into the combustion chamber and away from the exhaust port 33.

Figure 5:
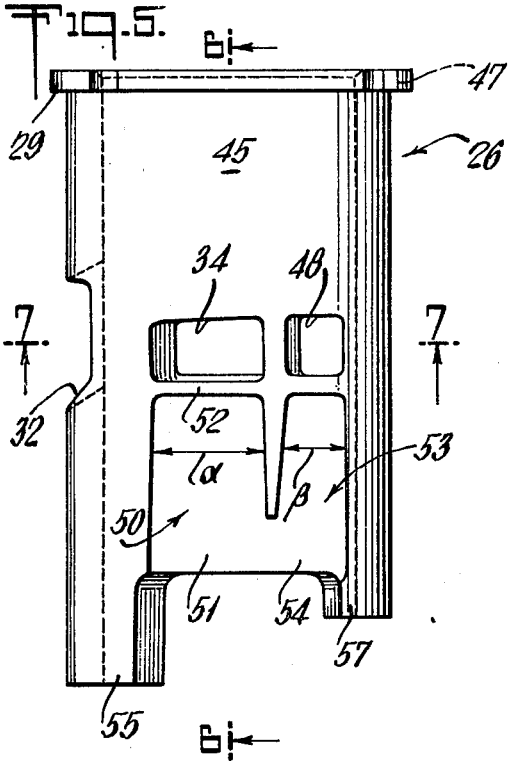
FIG. 5 is a view in elevation of a sleeve-liner part of FIG. 1.
Figure 6:
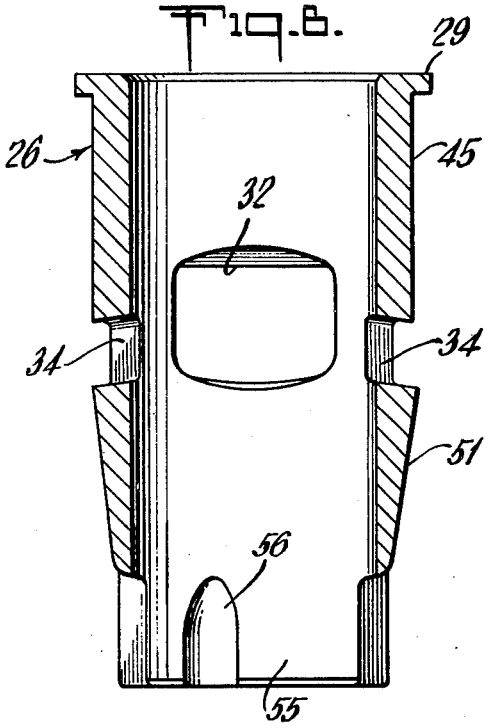
FIG. 6 is a sectional view taken on the line 6—6 of FIG. 5.
Figure 7:
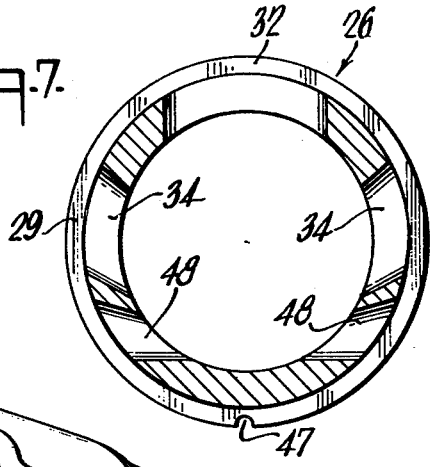
FIG. 7 is a sectional view taken on the line 7—7 of FIG. 5.
Figure 8:
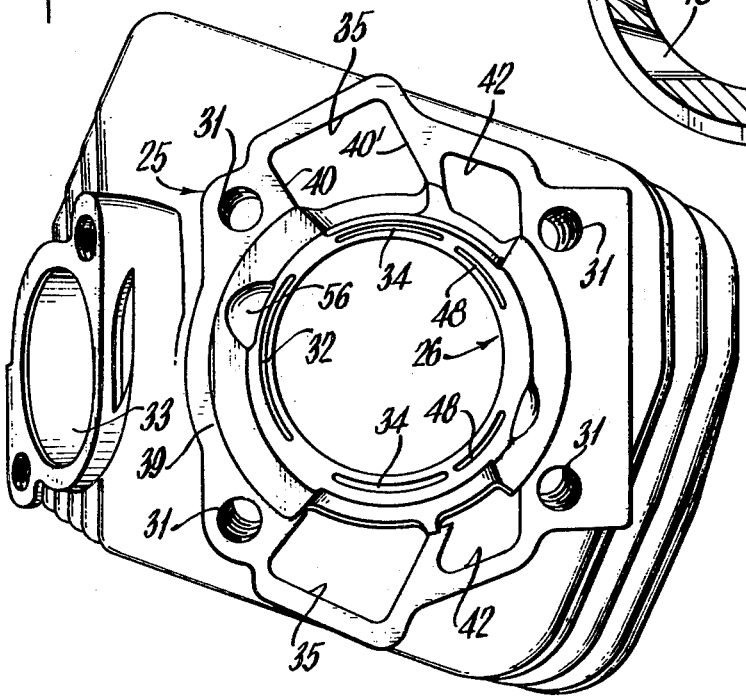
FIG. 8 is a perspective view of a completed cylinder subassembly of the invention, viewed upwardly and from the crankcase end thereof.

Turning now to the sleeve-liner part 26 per se, as shown in FIGS. 5, 6 and 7, its outer cylindrical surface 45 is sized for shrink fit assembly to the bore 37 of body part 25, with flange 29 seated in counterbore 30, and with the exhaust side port 32 in smooth continuous alignment and registry with the adjacent contour of exhaust port 33 in body 25; a locating pin 46 (FIG. 3) engages a local recess 47 in flange 29 (FIGS. 5, 7) to angularly retain the registered relationship of sleeve and body parts. Side ports 34 register with the upper ends of channels 35, and similar but smaller side ports 48 register with the correspondingly smaller channels 42, as will be understood. Finally, FIG. 7 reveals the precise care which can be given to formation of all ports 32–34–48 in sleeve 26, to the end that gas flows into and out of the combustion chamber are smooth, prompt and efficiently effected, the exhaust-scavenging action being promoted by convergence of all four inlet flows of combustible mixture in the direction 180° opposed to that of exhaust discharge, thus providing maximum assurance that fresh unburned mixture will have its greatest chance to displace (expel) exhaust products from the combustion chamber by the time when the rising piston cuts off the exhaust port 32.

As a further feature of the invention, attention is directed to groove or channel formations in the outer cylindrical surface 45 of sleeve 26, such formation being provided for each of the inlet ports 34–48 and for specific coaction and registry with a corresponding one of the body channels 35–42. Thus, as best seen in FIGS. 5 and 6, each one of a first pair of outwardly open grooves 50, of effective arcuate extent $\alpha$ conforming to that of body grooves 35, coacts to define with its corresponding groove 35 an enlarged and desirably characterized sectional profile for a transfer passage between the crankcase and the combustion chamber, profile change being determined at least in part by the ramp slope 51 of grooves 50. As shown, this passage profile commences with largest section at the crankcase end, and progressively converges as ramp 51 rises, ending at a bridge or throat 52 beyond which incoming fuel is directed into the combustion chamber. In like manner, each one of a second pair of outwardly open grooves 53, of effective arcuate extent $\beta$ conforming to that of body grooves 42, coacts to define with its corresponding groove 42 an enlarged and desirably characterized sectional profile for a smaller auxiliary transfer passage between the crankcase and the combustion chamber, profile change being determined at least in part by a ramp slope 54 in grooves 53 analogous to ramp slope 51 of grooves 50.

The structural description of sleeve 26 is completed by describing features of its crankcase end, all of which extend beyond the crankcase end of body part 25, to define a projecting skirt of irregular contour. The most downwardly projecting part of this profile is a tongue or baffle portion 55 having a limited local concavity 56 (FIG. 6) to enable connecting-rod clearance; portion 55 is of approximately 90° arcuate extent, overlapping both arcuate limits of the exhaust side-port 32 and serving to deny mixture access to the exhaust side of the cylinder. Diametrically opposite tongue 55 is a shorter tongue formation 57 to establish firm piloting reference of sleeve 26 in the engine-block bore into which it is fitted; tongue 57 is of substantially the angular extent of tongue 55 and may also have a limited local concavity 58 (see FIG. 2) to enable connecting-rod clearance. Tongues 55–57, being on opposite sides of the wrist-pin axis, will also be seen to provide added piloting and stabilizing support of piston 15, near the bottom-center region of its cycle, thus reducing any tendency to develop "piston-slap". Between tongues 55–57, and at least in angular registry with each of the respective transfer-passage groupings 34–35–50 and 48–42–54, the bottom skirt of sleeve 26 is cut away, providing maximum freedom for mixture access to the combustion chamber, via inlet ports 34–42.

Having thus described structural features of the invention, it is of utmost importance to point out that such structural features are realizable using die-casting techniques, for both the sleeve-liner part 26 and the cylinder-body part. Preferably, the material selected for die-casting is light in weight and high in thermal conductivity, and aluminum is admirably suited to the purpose. Die-casting enables precision duplication of the same parts, without need for subsequent machining of ports or passages. After casting the sleeve part 26, it is chrome-plated to desired size and finish. All necessary ports and transfer passages are fully defined upon the shrink-fitted assembly, with registration keyed by pin 46. The cylinder assembly 25–26 is bolted to the crankcase block 13, and head 27 is bolted to the cylinder. Assembled, the two die-cast pieces not only provide a structure hitherto achievable (in one piece) only through sand casting, but the new structure is superior because of the precision and repeatability of the die-casting process.

Some of the advantages of the indicated method and structure may be summarized:

1. Use of similar materials for body 25 and sleeve 26 means that their thermal-expansion coefficients may be the same or substantially the same. Preferably, the thermal-expansion capability of the liner slightly exceeds that of the cylinder body 25, thus assuring a tight cylindrical fitted interface under all operating conditions. This kind of relationship is in sharp contrast with the undesirable gaps which result, for example, from use of a steel liner in an aluminum block.

2. All components of the cylinder may be die-cast, with greatly enhanced precision, and no machining of exhaust ports, transfer ports or passages is required.

3. Chrome-plating of the cylinder is vastly simplified. In conventional practice, i.e., without the present invention, the entire cylinder must be handled in the chrome-plating process, e.g., the entire cylinder must be purged of grease and other contaminants prior to the plating process; on the other hand, in the present invention, only the liner part 26 need be handled. Mechanization of the plating process thus becomes much more readily realizable.

4. All known performance advantages of an all-aluminum cylinder structure with chromium-plated bore are realized at very substantially reduced cost.

5. Service and maintenance costs and operations are materially reduced. The present-day technique of repairing a scored or otherwise damaged cylinder requires at least a reboring, followed probably with a replating. On the other hand, with the invention, it is a simple matter to quick-chill the damaged liner to enable its pulled extraction from the body 25; the damaged liner 26 is quickly replaced with a new one off the shelf.

6. The two-part die-casting technique of the invention offers great flexibility for design and experimentation, particularly as to the orientation, configuration and sophistication or ports and ducting, all as may be indicated for various size and performance requirements.

It will be seen that the described invention meets all stated objects and provides for a superior product at substantial savings of cost and complexity.

While the invention has been described in detail for a preferred form and method, it will be understood that modifications may be made without departure from the claimed invention. For example, the particular arrangement of mixture-transfer passages is illustrative, and the invention lends itself to a variety of port-and-passage configurations, as for example the use of a "boost" port or ports in the wall or skirt of piston 15, for coaction with a port or ports in sleeve 26 (and a transfer passage in the body bore 17) to enable the transfer of an additional charge of combustible mixture to the combustion chamber.

What is claimed is:

1. A cylinder construction for a two-cycle engine utilizing crankcase compression of combustible mixture and side-ported exhaust, comprising a cylinder-body member having a cylindrical bore between a crankcase end and a head end, and having a side port between said ends, and a cylindrical sleeve-liner member closely fitted to the body-member bore and having an exhaust side port in registration with the side-port of said body member, said liner member having another side port intermediate said ends and offset from the exhaust side port, one of said members at its body-to-liner interface surface also having an elongate groove extending continuously between the region of said other side port and the crankcase end of said body member, whereby the groove defines with said body a transfer passage for combustible mixture from the crankcase end to the bore of said sleeve liner.

2. The cylinder construction of claim 1, in which said liner member is of aluminum and has a bore of deposited chromium.

3. The cylinder construction of claim 2, in which the deposited chromium is electroplated.

4. The cylinder construction of claim 1, in which said body member has a retaining counterbore concentric with the body bore and at the head end thereof, said sleeve-liner member including a radial flange seated in said counterbore.

5. The cylinder construction of claim 4, and including key means coacting between said members to maintain registration thereof.

6. The cylinder construction of claim 1, in which said groove is one of two registering grooves respectively formed in adjacent surfaces of said members and cooperating to define at least one transfer passage between the crankcase end of the cylinder and an inlet port of said sleeve-liner member.

7. The cylinder construction of claim 1, in which each of said members is of aluminum-base material.

8. The cylinder construction of claim 1, in which the materials of the respective members are such that the thermal coefficient of expansion of the sleeve-liner member is at least as great as that of the cylinder-body member.

9. The cylinder construction of claim 1, in which said other side port is one of a plurality of angularly spaced side ports in said liner member and intermediate said ends and off-set from the exhaust side port, and in which the groove in said one member is one of a plurality of such grooves each of which extends from said crankcase end to a different one of said plurality of other ports.

10. The cylinder construction of claim 1, in which said liner member has a plurality of angularly spaced side ports intermediate said ends and offset from the exhaust side port, and in which the groove in said one member extends continuously between a plurality of said other side ports and the crankcase end.

* * * * *